US011447353B2

(12) United States Patent
Wick

(10) Patent No.: US 11,447,353 B2
(45) Date of Patent: Sep. 20, 2022

(54) SHEET ORIENTATION DEVICE, MACHINE FOR PROCESSING A SHEET, AND METHOD FOR ORIENTING A SHEET

(71) Applicant: BOBST GRENCHEN AG, Grenchen (CH)

(72) Inventor: Stefan Wick, Oberbuchsiten (CH)

(73) Assignee: BOBST GRENCHEN AG, Grenchen (CH)

( * ) Notice: Subject to any disclaimer, the term of this patent is extended or adjusted under 35 U.S.C. 154(b) by 18 days.

(21) Appl. No.: 16/651,244

(22) PCT Filed: Oct. 9, 2018

(86) PCT No.: PCT/EP2018/025263
§ 371 (c)(1),
(2) Date: Mar. 26, 2020

(87) PCT Pub. No.: WO2019/072416
PCT Pub. Date: Apr. 18, 2019

(65) Prior Publication Data

US 2020/0270084 A1 Aug. 27, 2020

(30) Foreign Application Priority Data

Oct. 10, 2017 (DE) ..... 102017123521.3

(51) Int. Cl.
*B65H 9/00* (2006.01)
*B65H 7/08* (2006.01)

(52) U.S. Cl.
CPC ..... *B65H 9/002* (2013.01); *B65H 7/08* (2013.01); *B65H 2404/15212* (2013.01);
(Continued)

(58) Field of Classification Search
CPC ... B65H 7/08; B65H 7/10; B65H 7/20; B65H 2511/216; B65H 2701/1311;
(Continued)

(56) References Cited

U.S. PATENT DOCUMENTS 4,887,810 A 12/1989 Gritzmacher et al.
5,697,609 A * 12/1997 Williams ..... B65H 9/002 271/228
(Continued)

FOREIGN PATENT DOCUMENTS

DE 3804576 A1 10/1988
DE 102004060191 A1 6/2006
(Continued)

OTHER PUBLICATIONS

International Search Report dated Jan. 28, 2019, in counterpart International Patent Application No. PCT/EP2018/025263 (4 pages).
(Continued)

*Primary Examiner* — Prasad V Gokhale
(74) *Attorney, Agent, or Firm* — Bookoff McAndrews, PLLC

(57) ABSTRACT

The invention relates to a sheet alignment device (5) for a machine for the processing of sheets (B) consisting of a thin, flat material such as paper, cardboard or film, with a feed section, at least one sensor (30, 32) for determining the position and/or alignment of the sheet (B) and also at least two alignment modules (10), each having an alignment roller (12), to which a drive device (14) is assigned in each case, whereby there is assigned to each alignment module (10) a swivel device (16), with which the alignment roller (10) can be swivelled around a swivel axis (A) perpendicular to the feed section. The invention relates also to a machine for the processing of sheets (B) consisting of a thin, flat material such as paper, cardboard or film, whereby a sheet
(Continued)

Figure 1:
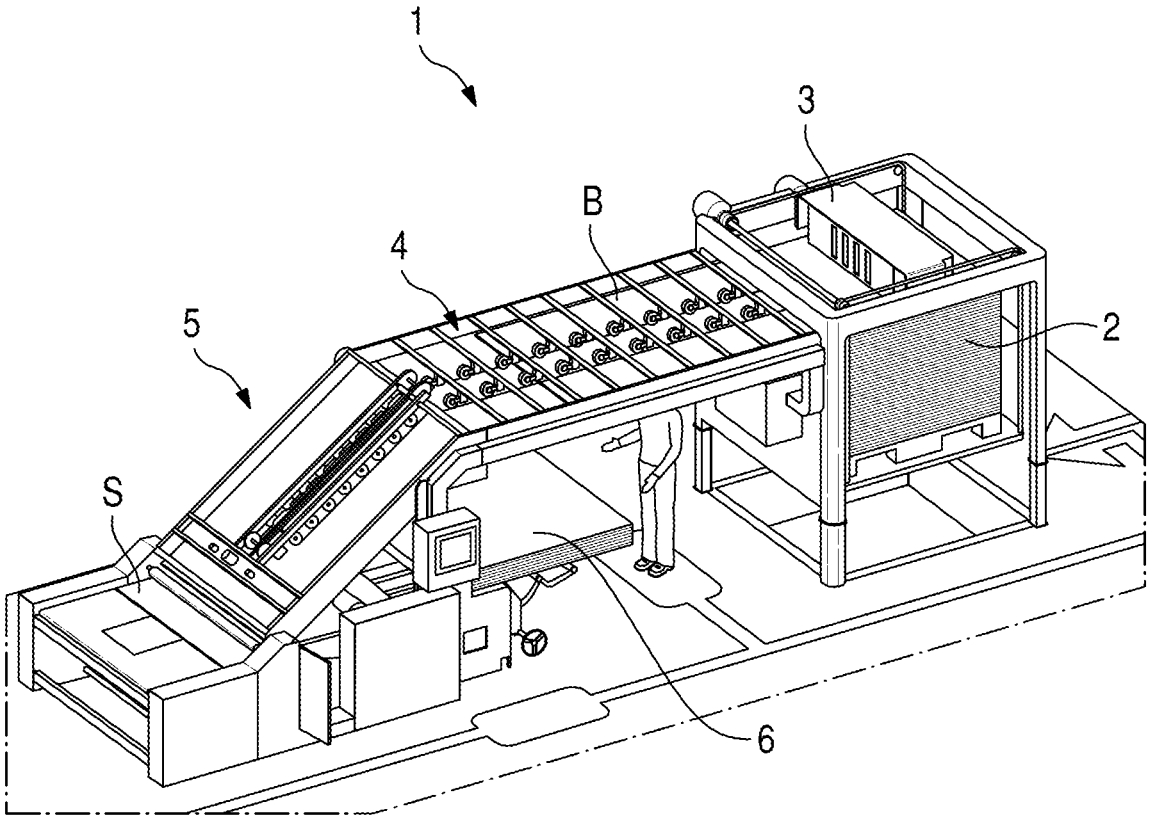

alignment device (5) of the aforementioned type is provided. The invention relates finally to a method for the aligning of a sheet (B) consisting of thin, flat material such as paper, cardboard or film by means of the following steps:

the alignment of the sheet (B) is determined, the sheet (B) is speeded up, turned and/or displaced laterally by means of at least two alignment rollers (12), controllable with regard to circumferential speed and alignment, on a feed section.

20 Claims, 5 Drawing Sheets

(52) U.S. Cl.
CPC ..... *B65H 2511/216* (2013.01); *B65H 2701/1311* (2013.01); *B65H 2801/21* (2013.01)

(58) Field of Classification Search
CPC ..... B65H 2801/21; B65H 9/002; B65H 9/16; B65H 9/166; B65H 2404/144; B65H 2404/1441; B65H 2404/152; B65H 2404/15212; B65H 2404/1523; B65H 2553/80; B65H 2553/81
See application file for complete search history.

(56) References Cited

U.S. PATENT DOCUMENTS 5,794,176 A * 8/1998 Milillo ..... B65H 7/08 271/228
6,059,284 A 5/2000 Wolf et al.
6,634,521 B1 * 10/2003 Hwang ..... B65H 9/002 221/228
8,074,982 B2 * 12/2011 Tharayil ..... B65H 7/10 271/228
10,114,327 B2 * 10/2018 Miyake ..... G03G 15/234
2005/0109450 A1 * 5/2005 Skoglund ..... B32B 38/1833 156/247
2010/0327518 A1 * 12/2010 Tharayil ..... B65H 7/10 271/226
2012/0025457 A1 * 2/2012 Inoue ..... B65H 9/002 271/227
2012/0286468 A1 * 11/2012 Ui ..... B65H 9/006 271/227
2013/0043294 A1 2/2013 Nishizawa et al.
2016/0023858 A1 * 1/2016 Mizuno ..... G03G 15/6567 271/228
2016/0280488 A1 9/2016 Watanabe et al.

FOREIGN PATENT DOCUMENTS

EP 1321404 A2 6/2003
EP 2305463 A1 4/2011
JP S61-229748 A 10/1986

OTHER PUBLICATIONS

Chinese Office Action dated Jan. 20, 2021 in counterpart Chinese Patent Application No. 201880066359.5 (8 pages, in Chinese with English translation).

* cited by examiner

SHEET ORIENTATION DEVICE, MACHINE FOR PROCESSING A SHEET, AND METHOD FOR ORIENTING A SHEET

CROSS-REFERENCE TO RELATED APPLICATION(S)

This application is a National Stage under 35 U.S.C. § 371 of International Application No. PCT/EP2018/025263, filed on Oct. 9, 2018, which claims priority to German Patent Application No. 102017123521.3, filed Oct. 10, 2017, the contents of all of which are incorporated by reference in their entirety.

The invention relates to a sheet alignment device for a machine for the processing of sheets consisting of a thin, flat material such as paper, cardboard or film, and also a machine for the processing of such a sheet and also a method for the aligning of such a sheet.

The machine can be a laminating machine, which applies a coating material, for example a plastic film, onto a substrate and bonds the two firmly together. The machine can also be for example a machine for the manufacture of corrugated cardboard. Other examples of applications are however also conceivable.

A sheet to be processed is removed from a stack of sheets by a sheet feeder and supplied to a feed section. Each sheet is then transported along the feed section as far as the place where it is for example laminated together with a further sheet. The transport along the feed section can be effected by rollers, conveyor belts etc.

It is known, to align the sheet along the feed section by means of a sheet alignment device. An example can be found in EP 2 305 463 A. There the position of a sheet that is being transported along the feed section is identified by means of sensors, and two transport rollers are controlled with regard to their speed, such that during further transport the sheet is turned into one direction or another around its vertical axis, until the margins of the sheet are parallel to the direction of movement along the feed section. Additionally the transport rollers can be repositioned in lateral direction, in order to correct any lateral misalignment of the sheet on the feed section.

The object of the invention consists in being able to correct any alignment of a sheet, which is being transported along the feed section, as easily as possible.

To achieve this object, according to the invention, a sheet alignment device for a machine for the processing of sheets consisting of a thin, flat material such as paper, cardboard or film is provided, with a feed section, at least one sensor for determining the position and/or alignment of the sheet and also at least two alignment modules, each having an alignment roller, to which a drive device is assigned in each case, whereby there is assigned to each alignment module a swivel device, with which the alignment roller can be swivelled around a swivel axis perpendicular to the feed section. The invention is based on the fundamental idea of controlling not only the speed of the alignment rollers in a suitable manner, but also the direction, in which the speed of the alignment rollers acts. In this way the previously separate steps of translational displacement of the sheets and of turning around a vertical axis are combined into a single step. The result is a simpler construction of the device.

Preferably the sensor comprises two position sensors upstream of the alignment modules, with which the front edge of a sheet moved along the feed section can be determined. The angle by which the alignment of the sheet needs to be corrected can be calculated very precisely from the time misalignment, with which the front edge of the sheet is determined by the two position sensors.

Preferably the sensor comprises an alignment sensor, with which a side edge and/or an alignment of the sheet can be determined. With the alignment sensor more particularly the lateral misalignment of the sheet being transported on the feed section can be determined. In this connection preferably the side edge in the region of the front edge of the sheet is determined, i.e. one of the front corners of the sheet.

The alignment roller cooperates preferably with a counter-roller, such that the friction is reduced.

In this connection preferably a pressure module is provided, with which the counter-roller is forced against the alignment roller. The pressure module guarantees that the friction forces needed to align the sheet act between the alignment roller and the sheet.

The pressure module can have a pneumatic cylinder, an eccentric, an electric motor or a solenoid, in order to force the counter-roller against the alignment roller in the desired manner. In this connection more particularly the counter-roller is moved briefly away from the pressure roller, when the front edge of a sheet reaches the alignment roller, and thereupon pressed again against the alignment roller. This guarantees that the position of a sheet does not change, when the sheet is grasped by the alignment roller.

The spacing of the alignment modules from one another is preferably adjustable, such that the sheet alignment device can be adapted to sheets with different dimensions.

The machine for the processing of the sheets comprises preferably a handling section for a substrate, whereby the sheet alignment device supplies the sheet to the handling section. In this connection the sheet alignment device is used preferably to synchronise the sheet, which is to be aligned, with the substrate, i.e. to ensure by means of suitable speeding-up or delaying, that the edge of a sheet comes together with the front edge of the assigned substrate.

With the machine and more particularly with the sheet alignment device it is possible to process sheets having a thickness of 0.1 to 1.2 mm. In this connection the sheets can have a grammage of 90 to 500 g/m$^2$ and also a size with a width of 400 to 1,650 mm and a length of 400 to 2,050 mm.

To achieve the aforementioned object, according to the invention, a method for the aligning of a sheet consisting of thin, flat material such as paper, cardboard or film is also provided, whereby in a first step the alignment of the sheet is determined and in a second step the sheet is speeded up, turned and/or displaced laterally by means of at least two alignment rollers, controllable with regard to circumferential speed and alignment, on a feed section. With regard to the resulting advantages attention is drawn to the above explanations, also with regard to the possibility for synchronising the sheet with a substrate.

Figure 2:
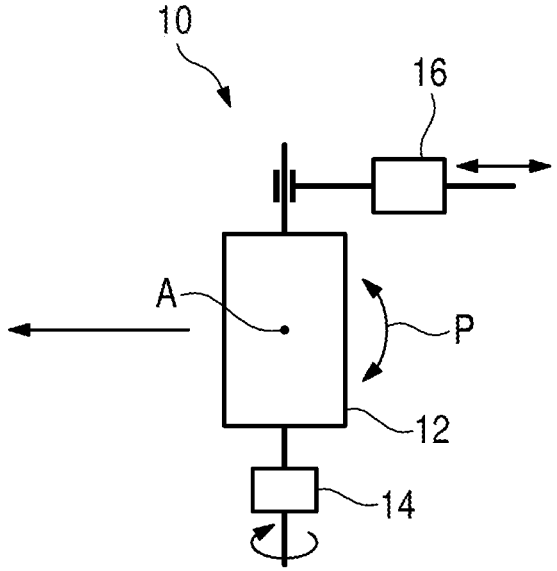
Figure 3:
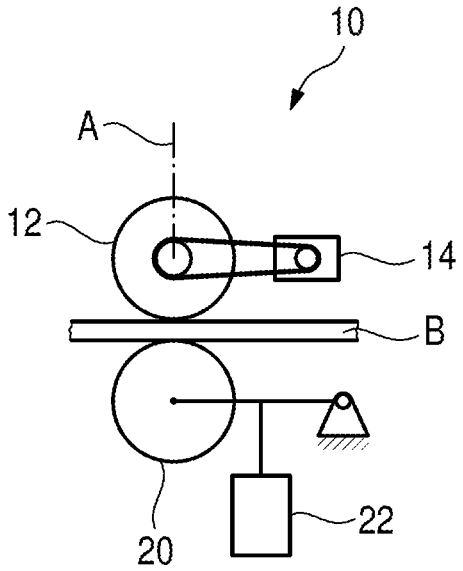
Figure 4:
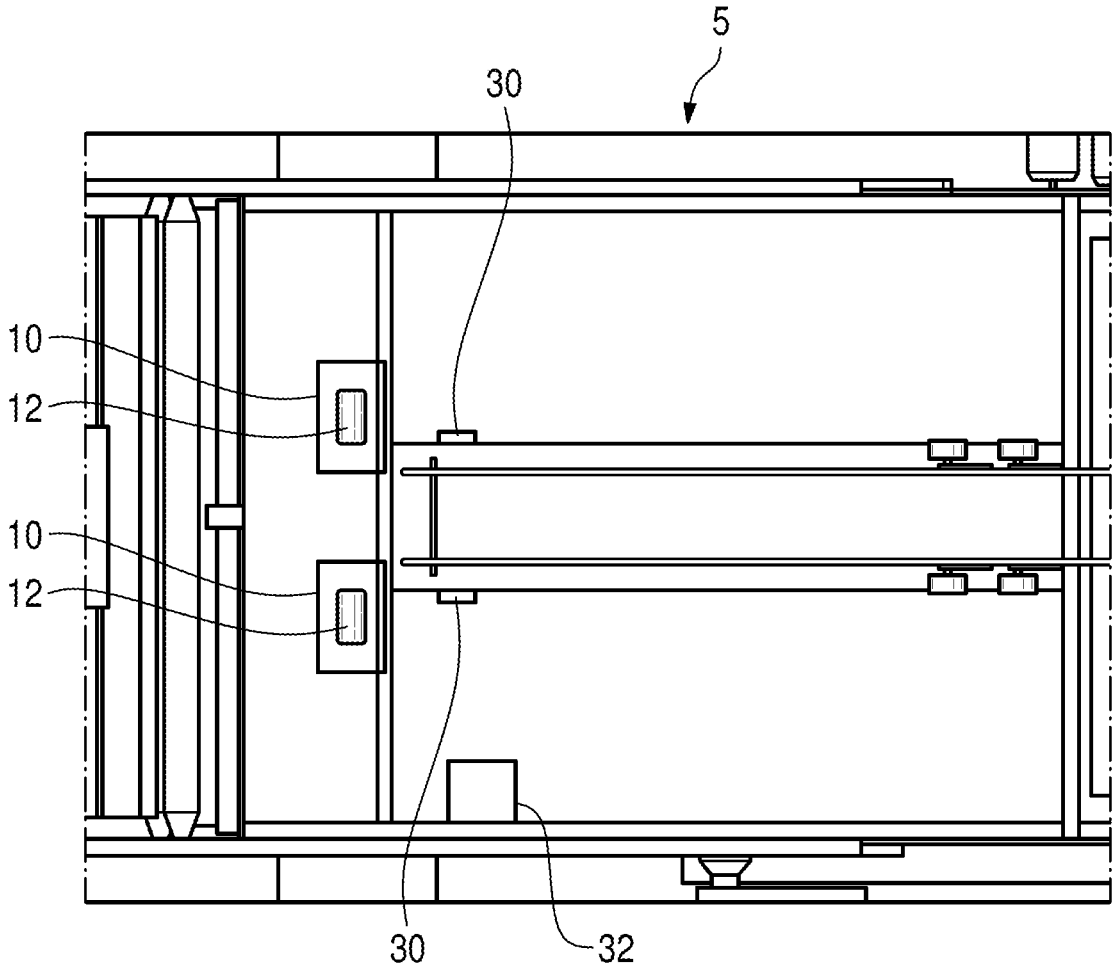
Figure 5:
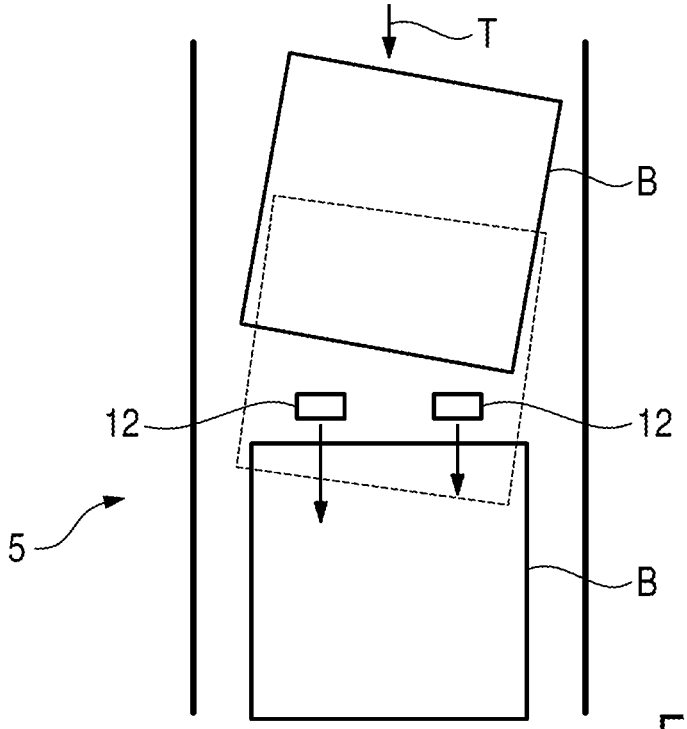
Figure 6:
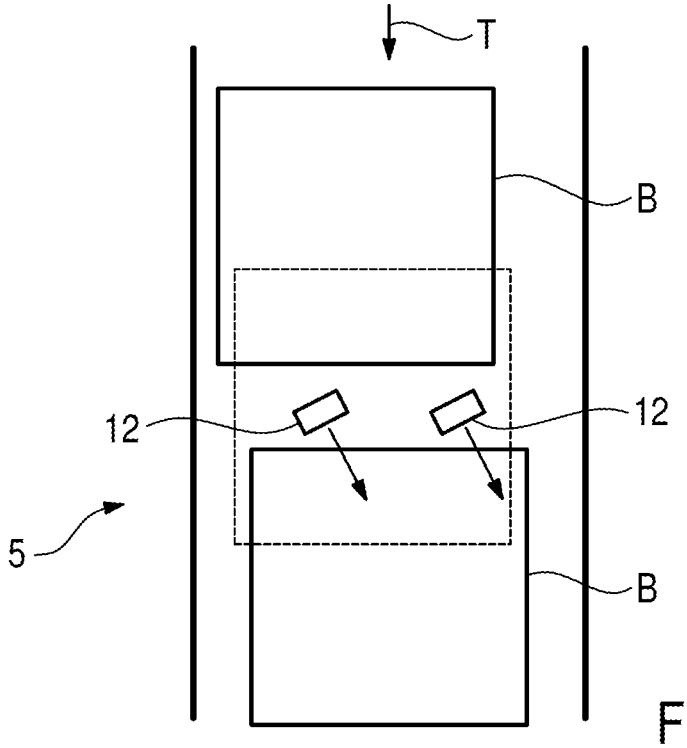

The invention is described below with the help of one embodiment, which is represented in the appended drawings, where the following are shown:

FIG. 1 a machine according to the invention in a perspective view;

FIG. 2 in a schematic top view an alignment module, which is used in a sheet alignment device integrated into the machine of FIG. 1;

FIG. 3 a schematic section through the alignment module of FIG. 2, which cooperates with a counter-roller;

FIG. 4 a schematic top view of the feed section provided with two alignment modules;

FIG. 5 schematically a first example of a correction of the alignment of a sheet, which is achieved with the sheet alignment device according to the invention;

FIG. 6 a second example of a correction; and

Figure 7:
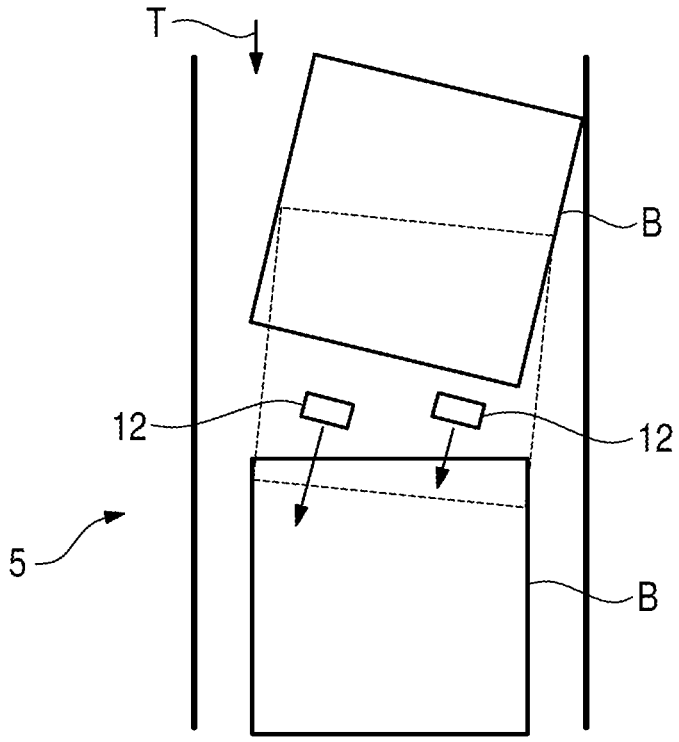

FIG. 7 a third example of a correction.

FIG. 1 shows a machine 1 for the processing of sheets consisting of a thin, flat material such as paper, cardboard or film. The sheets are staged in the form of a stack 2, from where they are supplied to a feed section 4 by means of a sheet feeder 3. A sheet B can be seen here on the feed section 4.

Integrated into the feed section 4 is a sheet alignment device 5, by means of which the alignment of the sheets B supplied via the feed section 4 can be corrected. The sheets B are then brought together with a substrate S, in order for example to be stuck or laminated together. The substrate sheets S are removed from a stack 6.

The sheet alignment device has two alignment modules 10 (see more particularly FIGS. 2 to 4), which each have an alignment roller 12 as essential part. Each of the alignment rollers 12 is provided to cooperate with the surface of a sheet that is to be aligned. For this purpose the alignment roller has at least on its circumferential surface a material that is characterised by a friction coefficient. The alignment roller 12 can consist for example of rubber.

Each alignment module 10 has a drive device 14, with which the rotational speed of the corresponding alignment roller 12 can be controlled. The drive device 14 can more particularly contain an electric motor.

Each alignment module 10 has furthermore a swivel device 16, with which the alignment roller 12 can be swivelled around a swivel axis A (see also the arrow P in FIG. 2). In this connection the swivel axis A stands perpendicular on the plane, along which the sheets B are transported through the sheet alignment device 5.

Each alignment roller 12 cooperates with a counter-roller 20, such that the sheets B can be moved through between the alignment roller 12 and the counter-roller 20.

Assigned to each counter-roller 20 is a pressure module 22, with which it is possible to control the pressure force, with which the counter-roller 20 is forced against the alignment roller 12. Moreover the counter-roller 20 can be moved away from the alignment roller 12 briefly by means of the pressure module, such that a sheet can be "threaded" into the gap between alignment roller 12 and counter-roller 20, without the front edge of the sheet being slowed down in the process.

In contrast to the alignment rollers 12 the alignment of the rotational axis of the counter-rollers 20 is not adjustable; the swivel axis always remains perpendicular to the direction along which the sheets are transported.

The counter-rollers 20 have at least on their circumferential surface a material that has a low friction coefficient. Accordingly the movement of a sheet in the region of the cooperation between an alignment roller 12 and the counter-roller 20 corresponds to the circumferential speed and alignment of the corresponding alignment roller 12.

The sheet alignment device 5 has furthermore sensors for determining the position and the alignment of the sheets B.

FIG. 4 shows two position sensors 30, which are arranged upstream of the two alignment modules 10. The two position sensors 30 are located "on the same level", such that they determine the front edge of a sheet B simultaneously, when this is aligned correctly.

The two position sensors 30 are arranged at such a spacing on the two sides of a central plane of the sheet alignment device 5, that they can determine the front edge of a sheet even if there is maximum lateral misalignment.

Basically, for the accuracy of determination, it is desirable to choose the largest possible spacing of the position sensors. In order however also to be able to determine smaller sheets, the spacing of the position sensors from one another can be adjusted.

The sheet alignment device 5 has furthermore an alignment sensor 32, which is arranged laterally. This serves to determine a side edge of a transported sheet B, more particularly in the region of the transition to the front edge. If the alignment of the front edge is known together with the position of the side edge for example on the transition to the front edge, it is possible to calculate not only, whether and optionally how much a sheet B is skewed relative to the correct alignment, but also, how far it is misaligned laterally.

Starting out from the signals of the sensors 30, 32, a control system not shown here calculates, how the alignment and/or position of each individual sheet must be corrected, in order for it to be brought together with the substrate S in the desired manner.

FIG. 5 shows schematically a sheet B, which is transported in the transport direction T along the sheet alignment device 5 and is aligned correctly there. In the example of FIG. 5 the sheet B in the initial state is skewed clockwise in comparison with its correct alignment. The two alignment modules 10 are therefore controlled, such that the sheet B, when the alignment rollers 12 cooperate with it, transport it somewhat faster on the left side than on the right side, such that the sheet B finally, when it is located downstream of the alignment modules 10, has its correct alignment (see the sheet B represented again in continuous lines downstream of the alignment rollers 12).

For simplification the higher speed of the left alignment roller 12 in FIG. 5 is represented by a longer speed arrow. In fact however, when the front edge of the sheet B that is to be aligned enters the gap between the alignment rollers 12 and the counter-rollers 20, the alignment rollers 12 will rotate at such a speed, that the circumferential speed of the alignment rollers corresponds to the speed of transport of the sheet. Only when the sheet has been grasped completely by the two alignment modules 10, is the left (in relation to FIG. 5) alignment roller 12 brought briefly up to a higher circumferential speed, such that the necessary correction of the alignment of the sheet B takes place. When the sheet B leaves the alignment rollers 12, these rotate again at a speed corresponding to the speed of transport of the sheet B.

With the alignment modules 10 it is also possible to synchronise the sheet with the substrate S, to which it is to be supplied. The sheet B can therefore be speeded up or delayed overall, such that the front edge of the sheet B meets the front edge of the substrate S exactly.

FIG. 6 shows a sheet B, which is misaligned laterally upstream of the alignment modules. Because the sheet B does not need to be turned, the alignment modules are therefore both operated at the same speed (this is represented by means of the two speed arrows, which are of equal length). However the alignment rollers 12 are adjusted by means of the swivel device, such that the sheet B overall is transported askew, until it adopts its correct position downstream of the alignment modules 12.

Here also it can be provided that, when the front edge of the sheet B enters the gap between the alignment rollers and the counter-rollers, the alignment rollers 12 are aligned in the transport direction of the sheet B and only thereupon are swivelled suitably for a short time. Before the back edge of the sheet leaves the alignment modules 10, the alignment rollers 12 have been swivelled round again by means of the swivel device 14, such that the rotational axis of the alignment rollers 14 is perpendicular to the longitudinal direction of the sheet alignment device and to the transport direction T.

FIG. 7 shows an example, in which the sheet B is both skewed and also misaligned laterally. Accordingly the alignment rollers 12 are both swivelled round, in order to compensate for the lateral misalignment, and also driven suitably at different speeds, in order to compensate for the skewing.

It is basically conceivable, that suitable sensors, which are able to determine the alignment and/or position of the sheets, B are provided also downstream of the alignment modules 10. In this case it is then possible to implement a closed-loop control system, which leads to an even greater precision in the correction of the alignment of the sheets B.

The invention claimed is:

1. A sheet alignment device for processing of sheets, the sheet alignment device comprising:

a feed section, at least one sensor for determining a position and/or an alignment of a sheet, at least two alignment modules, a first alignment module of the at least two alignment modules having a first alignment roller, a first drive device, and a first swivel device, the first alignment roller being driven by the first drive device, a second alignment module of the at least two alignment modules having a second alignment roller, a second drive device, and a second swivel device, the second alignment roller being driven by the second drive device, each of the first swivel device and the second swivel device swiveling the first alignment roller and the second alignment roller, respectively, around respective swivel axes perpendicular to a plane of the sheet alignment device, and a control system configured to:

calculate a skew amount and a misalignment amount based on the position and the alignment of the sheet; and based on the control system calculating that the skew amount indicates the sheet is not skewed and the misalignment amount indicates the sheet is misaligned laterally, control the first drive device to drive the first alignment roller to a same speed as the second drive device drives the second alignment roller, and control the first swivel device and the second swivel device to swivel the first alignment roller and the second alignment roller to a same adjustment about the respective swivel axes, wherein:

the first alignment roller and the second alignment roller cooperate respectively with a first counter-roller and a second counter-roller, each of the first counter-roller and the second counter-roller corresponds to a first pressure module and a second pressure module, respectively, to control a pressure force that the first counter-roller and the second counter-roller press against the first alignment roller and the second alignment roller, respectively, and the control system is further configured to, when a front edge of the sheet approaches a gap between the first alignment roller and the second alignment roller and the first counter-roller and the second counter-roller, control the first pressure module and the second pressure module to move the first counter-roller and the second counter-roller away from the first alignment roller and the second alignment roller, so that the sheet can be introduced into the gap without the front edge of the sheet being slowed down.

2. The sheet alignment device according to claim 1, wherein the at least one sensor includes two position sensors upstream of the at least two alignment modules, the two position sensors detecting a front edge of the sheet moved along the feed section.

3. The sheet alignment device according to claim 1, wherein the at least one sensor comprises an alignment sensor, with which a side edge and/or the alignment of the sheet can be detected.

4. The sheet alignment device according to claim 1, wherein each of the first pressure module and the second pressure module has a pneumatic cylinder, an eccentric, an electric motor or a solenoid.

5. A machine for the processing of the sheets, the machine comprising:

a sheet alignment device as claimed in claim 1.

6. The machine according to claim 5, wherein the sheet is aligned to a substrate, the sheet and the substrate are brought together, and the sheet and the substrate are affixed together.

7. The machine according to claim 5, wherein the sheets have a thickness of 0.1 to 1.2 mm.

8. The machine according to claim 5, wherein the sheets have a grammage of 90 to 500 g/m2.

9. The machine according to claim 5, wherein the sheets have a size with a width of 400 to 1,650 mm and a length of 400 to 2,050 mm.

10. A method for aligning a sheet using a sheet alignment device as claimed in claim 1, the method comprising:

determining the alignment of the sheet, and speeding up, turning, and/or displacing laterally the sheet by the first alignment roller and the second alignment roller, controllable with regard to circumferential speed and alignment, on the feed section.

11. The method according to claim 10, wherein the sheet is synchronized with a substrate.

12. The sheet alignment device of claim 1, wherein the control system is further configured to, when the skew amount indicates the sheet is not skewed and when the misalignment amount indicates the sheet is misaligned laterally:

when the front edge of the sheet enters the gap between the first alignment roller and the second alignment roller and the first and second counter-rollers, control the first swivel device and the second swivel device to align the first alignment roller and the second alignment roller in a transport direction of the sheet and, only thereupon, control the first swivel device and the second swivel device to swivel the first alignment roller and the second alignment roller to the same adjustment about the respective swivel axes for a time; and before a back edge of the sheet leaves the first alignment roller and the second alignment roller, control the first swivel device and the second swivel device to align the first alignment roller and the second alignment roller in the transport direction of the sheet.

13. The sheet alignment device of claim 1, wherein the control system is further configured to:

when the skew amount indicates the sheet is skewed and when the misalignment amount indicates the sheet is properly aligned laterally, control the first drive device to drive the first alignment roller at a higher speed than the second drive device drives the second alignment roller; and when the skew amount indicates the sheet is skewed and when the misalignment amount indicates the sheet is misaligned laterally, control the first drive device to drive the first alignment roller at the higher speed than the second drive device drives the second alignment roller, and control the first swivel device and the second swivel device to swivel the first alignment roller and the second alignment roller to the same adjustment about the respective swivel axes.

14. The sheet alignment device of claim 13, wherein the control system is further configured to, when the skew amount indicates the sheet is skewed and when the misalignment amount indicates the sheet is properly aligned laterally:

when the front edge of the sheet enters the gap between the first alignment roller and the second alignment roller and the first and second counter-rollers, control the first drive device and the second drive device to drive the first alignment roller and the second alignment roller at the same speed;

when the sheet has been grasped by the at least two alignment modules, control the first drive device to drive the first alignment roller to the higher speed; and when the sheet leaves the first alignment roller and the second alignment roller, control the first drive device and the second drive device to drive the first alignment roller and the first alignment roller at the same speed.

15. The sheet alignment device of claim 1, wherein the control system is further configured to control speeds and alignments of the first and second alignment rollers based on whether:

a front edge of the sheet has entered the gap between the first alignment roller and the second alignment roller and the first and second counter-rollers;

the sheet has been grasped by the at least two alignment modules; and a back edge of the sheet has left the first alignment roller and the second alignment roller.

16. The sheet alignment device of claim 15, wherein the control system is configured to control the first swivel device and the second swivel device to swivel the first alignment roller and the second alignment roller to the same adjustment for a time when the front edge of the sheet has entered the gap.

17. The sheet alignment device of claim 15, wherein, when the skew amount indicates the sheet is skewed and when the misalignment amount indicates the sheet is properly aligned laterally, the control system is configured to:

control the first drive device to drive the first alignment roller to a same speed as the second drive device drives the second alignment roller when the front edge of the sheet enters the gap; and control the first drive device to drive the first alignment roller at a higher speed when the sheet has been grasped.

18. A sheet alignment device for processing of sheets, the sheet alignment device comprising:

a feed section, at least one sensor for determining a position and/or an alignment of a sheet, at least two alignment modules, a first alignment module of the at least two alignment modules having a first alignment roller, a first drive device, and a first swivel device, the first alignment roller being driven by the first drive device, a second alignment module of the at least two alignment modules having a second alignment roller, a second drive device, and a second swivel device, the second alignment roller being driven by the second drive device, each of the first swivel device and the second swivel device swiveling the first alignment roller and the second alignment roller, respectively, around respective swivel axes perpendicular to a plane of the sheet alignment device, and a control system configured to:

calculate a skew amount and a misalignment amount based on the position and the alignment of the sheet;

based on the control system calculating that the skew amount indicates the sheet is not skewed and the misalignment amount indicates the sheet is misaligned laterally, control the first drive device to drive the first alignment roller to a same speed as the second drive device drives the second alignment roller, and control the first swivel device and the second swivel device to swivel the first alignment roller and the second alignment roller to a same adjustment about the respective swivel axes; and when the skew amount indicates the sheet is not skewed and when the misalignment amount indicates the sheet is misaligned laterally:

when a front edge of the sheet enters a gap between the first alignment roller and the second alignment roller and corresponding counter-rollers, control the first swivel device and the second swivel device to align the first alignment roller and the second alignment roller in a transport direction of the sheet and, only thereupon, control the first swivel device and the second swivel device to swivel the first alignment roller and the second alignment roller to the same adjustment about the respective swivel axes for a time; and before a back edge of the sheet leaves the first alignment roller and the second alignment roller, control the first swivel device and the second swivel device to align the first alignment roller and the second alignment roller in the transport direction of the sheet.

19. A sheet alignment device for processing of sheets, the sheet alignment device comprising:

a feed section, at least one sensor for determining a position and/or an alignment of a sheet, at least two alignment modules, a first alignment module of the at least two alignment modules having a first alignment roller, a first drive device, and a first swivel device, the first alignment roller being driven by the first drive device, a second alignment module of the at least two alignment modules having a second alignment roller, a second drive device, and a second swivel device, the second alignment roller being driven by the second drive device, each of the first swivel device and the second swivel device swiveling the first alignment roller and the second alignment roller, respectively, around respective swivel axes perpendicular to a plane of the sheet alignment device, and a control system configured to:

calculate a skew amount and a misalignment amount based on the position and the alignment of the sheet;

based on the control system calculating that the skew amount indicates the sheet is not skewed and the misalignment amount indicates the sheet is misaligned laterally, control the first drive device to drive the first alignment roller to a same speed as the second drive device drives the second alignment roller, and control the first swivel device and the second swivel device to swivel the first alignment roller and the second alignment roller to a same adjustment about the respective swivel axes; and control speeds and alignments of the first and second alignment rollers based on whether:

a front edge of the sheet has entered a gap between the first alignment roller and the second alignment roller and corresponding counter-rollers;

the sheet has been grasped by the at least two alignment modules; and a back edge of the sheet has left the first alignment roller and the second alignment roller, wherein, when the skew amount indicates the sheet is skewed and when the misalignment amount indicates the sheet is properly aligned laterally, the control system is configured to:

control the first drive device to drive the first alignment roller to a same speed as the second drive device drives the second alignment roller when the front edge of the sheet enters the gap; and control the first drive device to drive the first alignment roller at a higher speed when the sheet has been grasped.

20. The sheet alignment device of claim 19, wherein the control system is configured to control corresponding pressure modules to move the corresponding counter-rollers away from the first alignment roller and the second alignment roller so that the sheet can be introduced into the gap without the front edge of the sheet being slowed down.

* * * * *